US011761292B2

(12) United States Patent
Ball

(10) Patent No.: US 11,761,292 B2
(45) Date of Patent: Sep. 19, 2023

(54) INFLATABLE ELEMENT SYSTEM FOR DOWNHOLE TOOLS

(71) Applicant: Halliburton Energy Services, Inc., Houston, TX (US)

(72) Inventor: David Earl Ball, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 0 days.

(21) Appl. No.: 17/655,578

(22) Filed: Mar. 21, 2022

(65) Prior Publication Data

US 2023/0091554 A1 Mar. 23, 2023

Related U.S. Application Data

(60) Provisional application No. 63/246,505, filed on Sep. 21, 2021.

(51) Int. Cl.

| | |
|---|---|
| ***E21B 33/124*** | (2006.01) |
| ***E21B 34/06*** | (2006.01) |
| ***E21B 33/127*** | (2006.01) |

(52) U.S. Cl.

CPC ..... *E21B 33/1243* (2013.01); *E21B 33/124* (2013.01); *E21B 33/127* (2013.01); *E21B 34/06* (2013.01)

(58) Field of Classification Search

CPC ..... E21B 33/12; E21B 33/1243; E21B 34/06; E21B 33/127; E21B 33/124; E21B 23/06

See application file for complete search history.

(56) References Cited

U.S. PATENT DOCUMENTS

| | | | |
|---|---|---|---|
| 4,791,992 | A | 12/1988 | Greenlee et al. |
| 7,296,462 | B2 | 11/2007 | Gregory et al. |
| 2013/0126191 | A1 | 5/2013 | Brennan, III et al. |
| 2020/0248524 | A1 | 8/2020 | Corre et al. |

FOREIGN PATENT DOCUMENTS

| | | |
|---|---|---|
| WO | WO 2015/03274 A2 | 1/2015 |
| WO | WO 2015/085427 A1 | 6/2015 |

OTHER PUBLICATIONS

Search Report and Written Opinion issued for International Patent Application No. PCT/US2022/071232, dated Jun. 28, 2022, ISA/KR, 11 pages.

*Primary Examiner* — Yong-Suk (Philip) Ro

(74) *Attorney, Agent, or Firm* — John Wustenberg; C. Tumey Law Group PLLC

(57) ABSTRACT

A straddle packer assembly for deployment in a wellbore in which the straddle packer assembly includes a mandrel on which is mounted a first inflatable element and a second inflatable element. A first end of the first inflatable element is fixed, while a second end slides on the mandrel. Both the first and second ends of the second inflatable element are slidable on the mandrel, and the first end of the second inflatable element is coupled to the second end of the first inflatable element. The inflatable elements are inflated separately, with the first inflatable element inflated first until it seats against the wellbore wall. As the first inflatable element expands radially and contracts axially, the second inflatable element moves in axial concert with the first inflatable element so as to maintain a fixed distance between the two inflatable elements.

20 Claims, 4 Drawing Sheets

INFLATABLE ELEMENT SYSTEM FOR DOWNHOLE TOOLS

CROSS-REFERENCE TO RELATED APPLICATION

This application claims the benefit of the filing date of, and priority to, U.S. Patent Application No. 63/246,505, filed Sep. 21, 2021, the entire disclosure of which is hereby incorporated herein by reference.

BACKGROUND

A straddle packer is a packer assembly with at least one upper packer separated from at least one lower packer by a spacer of a length selected to correspond to a production zone of interest. The two packers isolate the production zone from the wellbore.

The upper packer and lower packer can be inflated separately or, more commonly at the same time. Regardless, as the packers or inflatable elements are expanded on a mandrel, the distance, and thus the annular volume between the two packers increases. Commonly for straddle packer arrangements, one end (usually the uphole end) of each packer is fixed and the other end (usually the downhole end) is axially movable so that for each individual packer, the axially movable end is drawn toward the fixed end as the packer is inflated. Specifically, during typical inflation of the elements of a straddle packer, the inflation causes the elements to change shape in order to seal against the wellbore wall or casing. The change in shape shortens the axial length of each packer element and increases the distance and volume between adjacent elements. Once inflated, the annular area defined between the upper and lower packers and the wellbore wall must be cleared of drilling mud before formation fluids will begin to flow into the annular area. As such, the greater the spacing between the upper and lower packers, the greater the volume of mud that must be cleared from the annular area prior to formation fluid flow.

Various embodiments of the present disclosure will be understood more fully from the detailed description given below and from the accompanying drawings of various embodiments of the disclosure. In the drawings, like reference numbers may indicate identical or functionally similar elements. Embodiments are described in detail hereinafter with reference to the accompanying figures, in which.

DETAILED DESCRIPTION OF DISCLOSURE

Figure 1:
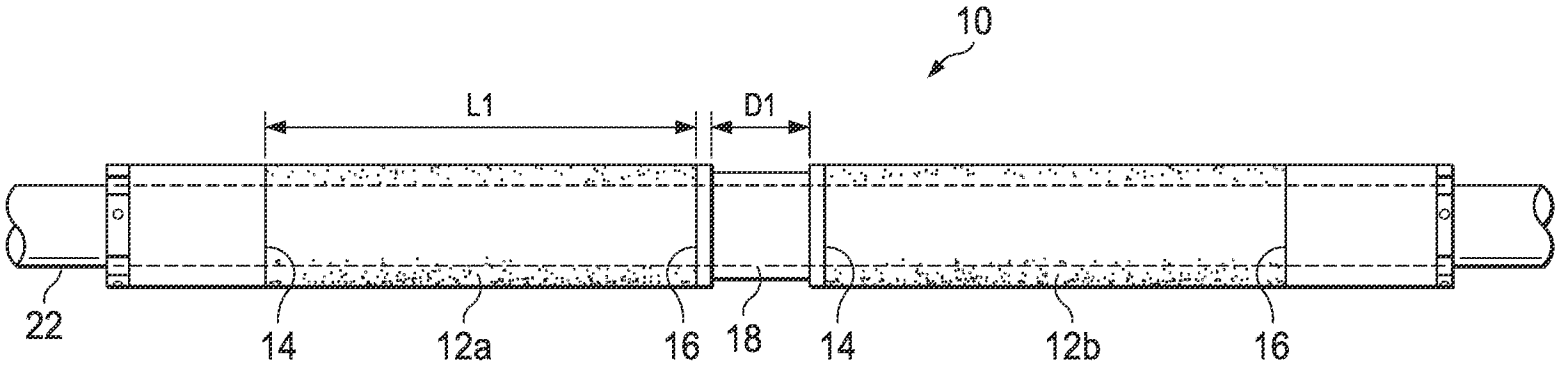
FIG. 1 is an elevation view of an embodiment of a straddle packer assembly having two coupled inflatable elements deflated.

With reference to FIG. 1, provided herein is a straddle packer assembly 10 and method of operation. The straddle packer assembly 10 includes at least two inflatable elements 12, namely a first inflatable element 12*a* and a second inflatable element 12*b*, each having a first end 14 and a second end 16. In some embodiments, the first inflatable element 12*a* and the second inflatable element 12*b* may be integrally formed as a single elastomeric component which is clasped between the ends to define the first inflatable element 12*a* and the second inflatable element 12*b*. Alternatively, in other embodiments, the first inflatable element 12*a* and the second inflatable element 12*b* may be formed of spaced apart, separate elastomeric pieces. The second end 16 of one inflatable element 12 is movably coupled to the first end 14 of the other inflatable element 12 so that upon inflation, one of the inflatable elements 12 is caused to move axially towards the other inflatable element. Thus, as shown, the second end 16 of first inflatable element 12*a* is movably coupled to the first end 14 of the second inflatable element 12*b*. In other embodiment, a slidable element 18 is disposed between the two inflatable elements 12*a*, 12*b*. Where inflatable elements 12*a*, 12*b* are separate (as opposed to integrally formed), slidable element 18 couples the first end 14 of the second inflatable element 12*b* to the second end 16 of the first inflatable element 12*a* so that as inflatable element 12*a* expands radially outward, the distance D between the two inflatable elements 12*a*, 12*b* as established by the length of slidable element 18 remains constant. Where inflatable elements 12*a*, 12*b* are integrally formed as a single component, slidable element 18 is positioned between the first end 14 of the second inflatable element 12*b* and the second end 16 of the first inflatable element 12*a* to clasp the integrally formed elastomeric component, so as to define the separate inflatable elements 12*a*, 12*b* where these inflatable elements 12*a*, 12*b* essentially form upper and lower portions of the single elastomeric component. In this regard, slidable element 18 functions not only to space the inflatable elements 12*a*, 12*b* a desired distance from one another, but also to seal the second end 16 of inflatable element 12*a* and the first end 14 of inflatable element 12*b*, such that inflatable elements 12*a*, 12*b* can be inflated separately as described below. In certain embodiments, the distance D need not be limited to a particular distance so long as it remains constant or at least does not increase as the inflatable elements 12 are inflated.

Figure 2:
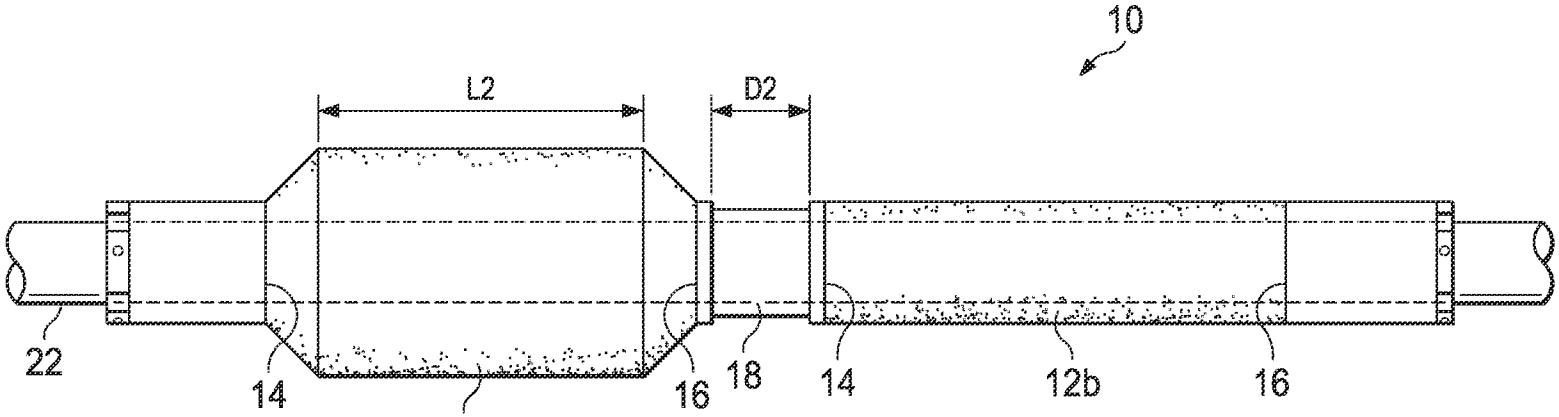
FIG. 2 is the straddle packer assembly of claim 1 with one inflatable element inflated.
Figure 3:
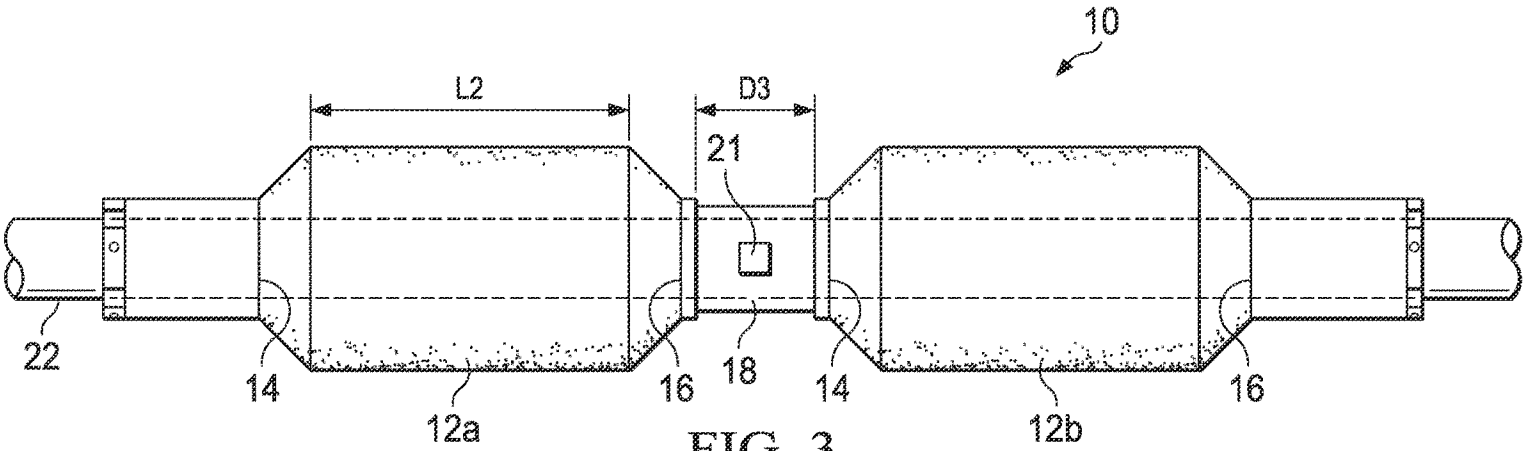
FIG. 3 is the straddle packer assembly of claim 1 with both inflatable elements inflated.

In one embodiment, first inflatable element 12*a* has a first end 14 and a second end 16, where the first end 14 is fixed and the second end 16 is movable, and a second inflatable element 12*b* has a first end 14 and a second end 16, where each of the first and second ends 14, 16, respectively, of the second inflatable element 12*b* are axially movable. In this embodiment, the first end 14 of the second inflatable element 12*ab* is coupled to the second end 16 of the first inflatable element 12*a*. In one or more embodiments, the first and second inflatable elements 12*a*, 12*b* may be mounted on a mandrel 22, wherein the first end 14 of the first inflatable element 12*a* is fixed to the mandrel 22, while the second end 16 of the first inflatable element 12*a*, as well as the first and second ends 14, 16, respectively, of the second inflatable element 12*b* slidingly engage the mandrel 22. Mandrel 22 may be any tubular or guide that permits certain of the ends of the inflatable elements 12 to move axially as described herein. Thus, as the first inflatable element 12*a* is inflated and expands radially outward (as shown in FIG. 2), the axial length of the first inflatable element decreases from L1 (see FIG. 1) to L2 (see FIG. 2), thereby drawing the second inflatable element 12*b* (slidingly mounted on the mandrel 22 and coupled to the second end 16 of the first inflatable element 12*a*) towards the first inflatable element 12*a*. FIG. 3 shows each of first and second inflatable elements 12*a*, 12*b* as radially expanded. Notably, the distance D between the inflatable elements has not changed between the different states of the straddle packer assembly, such that distance D3 of FIG. 3 (where both inflatable elements are radially expanded) is the same as distance D2 of FIG. 2 (where only the first inflatable element is inflated), which is the same as distance D1 of FIG. 1 (where neither inflatable element is radially expanded).

Slidable element 18 may include one or more flow control mechanisms 21, such as ports or inflow control devices, to allow wellbore fluid adjacent slidable element 18 to flow into mandrel 22. In one or more embodiments, slidable element 18 is a sleeve. Moreover, as used herein, "slidable" refers to the ability of slidable element 18 to move axially with the second end 16 of first inflatable element 12*a* and with the first and second ends 14, 16 respectively of second inflatable element 12*b*.

While only two inflatable element 12*a*, 12*b* are shown, in other embodiments of straddle packer assembly 10, additional inflatable elements may be included and coupled together in a spaced apart arrangement. In such embodiments, it will be appreciated that all of the additional inflatable elements are coupled together and slidingly engaged with mandrel 22 so that the additional inflatable element all move axially in concert with the second end 16 of the first inflatable element 12*a* and the second inflatable element 12*b*. In this regard, the inflatable elements 12 may be integrally formed as a single elastomeric component with a plurality of spaced apart slidable elements 18 defining each inflatable element 12.

Figure 4:
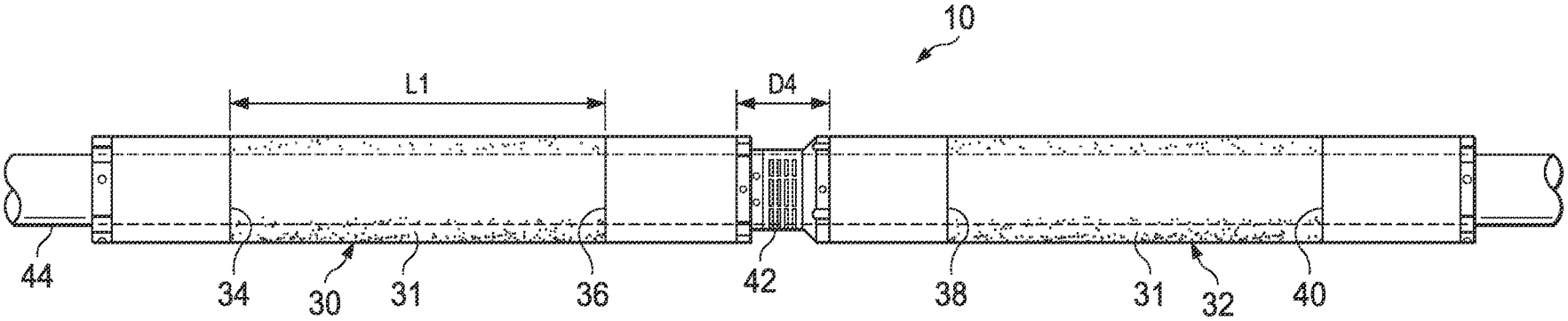
FIG. 4 is an elevation view of an embodiment of a straddle packer assembly having two coupled packer assemblies deflated.
Figure 5:
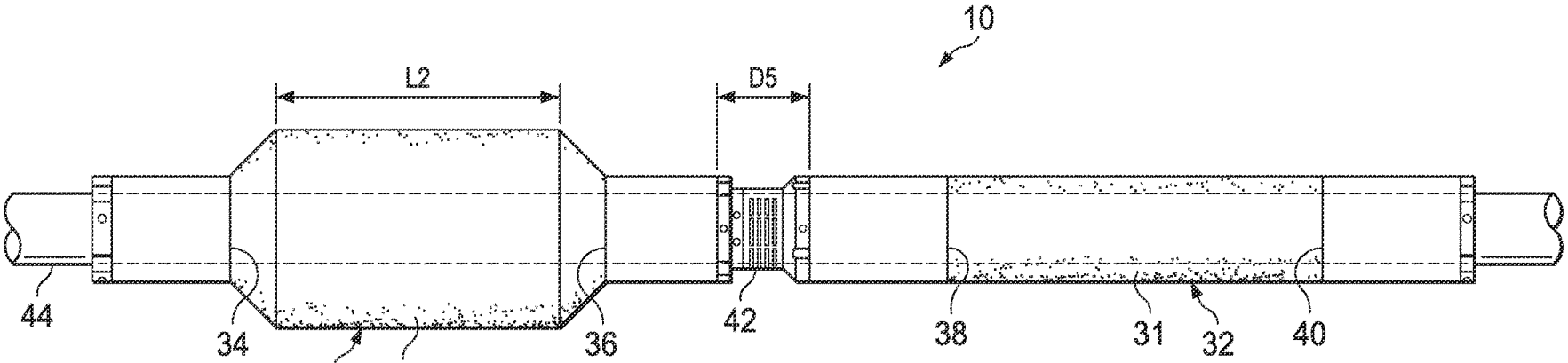
FIG. 5 is the straddle packer assembly of claim 1 with one inflatable element inflated.
Figure 6:
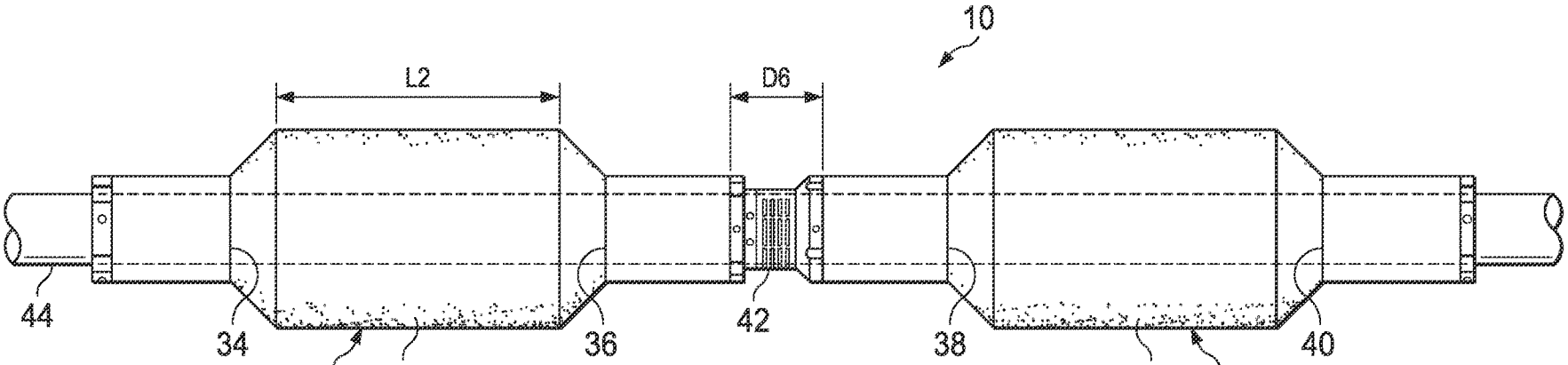
FIG. 6 is the straddle packer assembly of claim 1 with both inflatable elements inflated.

Shown in FIGS. 4-6 is another embodiment of a straddle packer assembly 10 where there are at least two inflatable elements in the form of packer assemblies. Specifically, a first packer assembly and a second packer assembly 32 are shown. First packer assembly 30 has a first end 34 and a second end 36, and second packer assembly 32 has a first end 38 and a second end 40. The second end 36 of the first packer assembly 30 is movably coupled to the first end 38 of the second packer assembly 32 so that upon activation of the first packer assembly 30, the second packer assembly 32 moves axially towards the first packer assembly 30 as the inflatable packer element 31 of the first packer assembly 30 expands radially outward. In one or more embodiments, a slidable element 42 is disposed between the two packer assemblies 30, 32 to couple the first end 38 of the second packer assembly 32 to the second end 36 of the first packer assembly 30 so that as the packer elements 31 of the packer assemblies 30, 32 expand radially outward, the distance D4 between the two packer assemblies 30, 32, as established by the axial length of slidable element 42, remains constant.

In one embodiment, the first end 34 of first packer assembly 30 is fixed while the second end 36 is axially movable, and each of the first and second ends 38, 40 of the second packer assembly 32 are axially movable. In one or more embodiments, the first and second packer assemblies 30, 32 may be mounted on a mandrel 44, wherein the first end 34 of the first packer assembly 30 is fixed to the mandrel 44, while the second end 36 of the first packer assembly 30, as well as the first and second ends 38, 40 of the second packer assembly 32 slidingly engage the mandrel 44. Mandrel 22 may be any tubular or guide that permits certain of the ends of packer assemblies 30, 32 to move axially as described herein. In this embodiment, second packer assembly 32 is slidingly mounted on mandrel 44 such that the entire second packer assembly 32 can slide axially along mandrel 44. In other embodiments, at least the first end 38 of the second packer assembly 32 is disposed to move axially towards the first packer assembly 30 as the first packer assembly 30 is actuated to inflate packer element 31.

Thus, as the packer element 31 of first packer assembly 30 is inflated and expands radially outward (as shown in FIG. 5), the axial length of the first packer assembly 30 decreases from L1 (see FIG. 4) to L2 (see FIG. 5), thereby drawing the second packer assembly 32 (slidingly mounted on the mandrel 44 and coupled to the second end 36 of the first packer assembly 30) towards the first packer assembly 30. FIG. 6 shows each of first and second packer assemblies 30, 32 with expanded packer elements 31. Notably, the distance D between the packer assemblies 30, 32 has not changed between the different states of the straddle packer assembly 10, such that distance D6 of FIG. 6 (where both packer elements 31 are inflated) is the same as distance D5 of FIG. 5 (where only the packer element 31 of first packer assembly 30 is inflated), which is the same as distance D4 of FIG. 4 (where neither packer element 31 is inflated). While only two packer assemblies 30, 32 are shown, in other embodiments of straddle packer assembly 10, additional packer assemblies may be included and coupled together in a spaced apart arrangement. In such embodiments, it will be appreciated that all of the additional packer assemblies are coupled together and slidingly mounted on mandrel 44 so that the additional packer assemblies all move axially in concert with the second end 36 of the first packer assembly 30 and the second packer assembly 32, all while maintaining a fixed distance D between one another as the packer assemblies are inflated.

Figure 7:
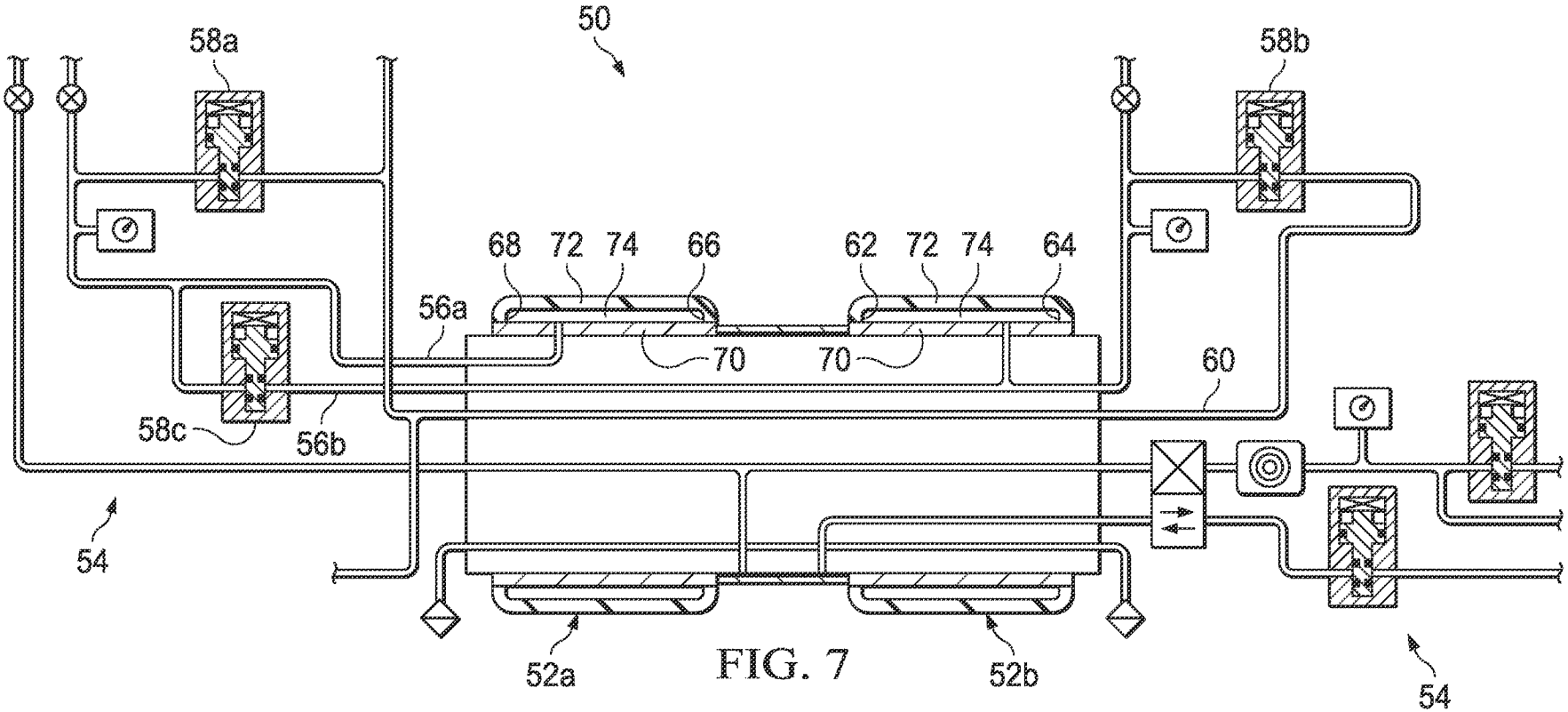
FIG. 7 is a schematic of an inflation manifold assembly used for sequentially inflating a straddle packer assembly.

With reference to FIG. 7, a schematic of a straddle packer assembly 50 having at least two radially expandable components 52 that are coupled together as described above illustrates the inflation manifold assembly 54 for the radially expandable components 52, whether those are in the form of expandable elements or individual packers as described above. It will be appreciated that the manifold assembly 54 is provided so that the radially expandable components 52 can be inflated separately from one another during installation of the straddle packer assembly 50. The manifold assembly 54 includes at least two inflation lines 56*a*, 56*b* and corresponding valves 58*a*, 58*b* to control flow from a common line 60, thereby allowing the radially expandable components 52 to be isolated from one another and individually filled.

In any event, it will be appreciated that a first radially expandable component 52*a* and a second radially expandable component 52*b* are coupled together so that the first end 62 and second end 64 of the second radially expandable component 52*b* move axially in conjunction with axial movement of the second end 66 of the first radially expandable component 52*a*. In this embodiment, the first end 68 of the first radially expandable component 52*a* is fixed while the other ends 62, 64, 66 are slidable. In one or more embodiments, each radially expandable component 52 may include an inner elastomeric sleeve 70 with an outer elastomeric sheath 72 so as to form a cavity 74 between the sleeve 70 and the sheath 72.

In the illustrated embodiment, the common flowline 60 is used to inflate both radially expandable components 52, but the separate valves 58*a*, 58*b* allow the radially expandable components 52*a*, 52*b* to be inflated separately. In particular, a first valve 58*a* controls the flow of a fluid, such as mud, into the cavity 74 of the first radially expandable component 52*a*, and a second valve 58*b* controls flow of fluid into the cavity 74 of the second radially expandable component 52*b*. During operation, it will be appreciated that the first radially expandable component 52*a*, which has a first end 68 that is fixed, is expanded first. This has the effect of causing the slidable second end 66 of the first radially expandable component 52*a* to move axially towards the fixed first end 68. Likewise, because i) the first end 62 and second end 64 of the second radially expandable component 52*b* are also axially slidable and ii) first end 62 second radially expandable component 52*b* is coupled to second end 66 of first radially expandable component 52*a*, second radially expandable component 52*b* will also move towards the fixed first end 68 of the first radially expandable component 52*a*. The sequence of filling the radially expandable components 52 permits the second radially expandable component 52*b* to slide axially before it is fully inflated and made to seat against a wellbore wall. As used herein, "wellbore wall" may refer to a casing wall with regards to cased wellbores and to a formation wall with regards to uncased wellbores. In this regard, it will be appreciated that first radially expandable component 52*a* need not be fully expanded and in contact with a wellbore wall before initiating filling of the second radially expandable component 52*a*. Rather, the first radially expandable component 52*a* must be seated against the wellbore wall before the second radially expandable component 52*b* contacts the wellbore wall so as not to interfere with axial movement of the second radially expandable component 52*b*. Thus, filling of the second radially expandable component 52*b* may begin before first radially expandable component 52*a* is fully expanded and seated against a wellbore wall so long as the radially expanded sheath 72 of the second radially expandable component 52*b* does not seat against the wellbore wall until the first radially expandable component 52*a* is fully inflated to the desired pressure and seated against the wellbore wall.

A third valve 58*c* may be provided to permit pressure between the first and second radially expandable components 52*a*, 52*b* to be equalized as desired once first and second radially expandable components 52*a*, 52*b* have been inflated as described above. Moreover, this valving provides the ability to inflate individual radially expandable components 52 with different pressures, keep the inflation pressures different, or balance the inflation pressure as desired. If required, the individual inflation pressures could be re-established.

As described, such a straddle packer assembly 50 and method of inflation minimizes the distance and volume between the radially expandable components 52*a*, 52*b*, which in turn minimizes the time required to achieve a clean sample from the formation. Notably, the first radially expandable component 52*a* and second radially expandable component 52*b* may have different inflation pressure. Likewise, radially expandable components 52*a*, 52*b* may have different axial lengths.

In one or more embodiments, once the first radially expandable component has seated against a wellbore wall, the second end of the first radially expandable component and the first end of the second radially expandable component may be fixed relative to the mandrel so that only the second end of the second radially expandable component remains free to slide axially. Thereafter, the second radially expandable component is inflated, thereby drawing the second end of the second radially expandable component axially towards the fixed ends of the first radially expandable component and the fixed first end of the second radially expandable component. In this way, the distance between the first and second radially expandable components remains constant.

While the straddle packer assembly 50 and method of inflation has been described utilizing two radially expandable components 52*a*, 52*b*, it will be appreciated that additional radially expandable components may be included. In such case, during installation of the straddle packer assembly, the first radially expandable component will be set first, drawing the other radially expandable components towards it. Thereafter, the second radially expandable component will be set, drawing the remaining uninflated radially expandable components towards it. This process may be repeated, successively expanding, one at a time, each additional radially expandable component until the radially expandable component most distal to the first radially expandable component is inflated. It will be appreciated that it is the single attachment point for the first radially expandable component 52*a* during installation of the straddle packer assembly 50, and the elimination of attachment points for the other radially expandable components that permits the forgoing system to achieve the above described results.

In one or more embodiments, the straddle packer assembly 50 is deployed utilizing a wireline, slickline, coiled tubing, tubing string, or other conveyance mechanism.

Thus, a straddle packer assembly has been described. In one or more embodiments, the straddle packer assembly may include a first inflatable element and a second inflatable element, each having a first end and a second end; wherein the first end of the first inflatable element is fixed and the second end of the first inflatable element is axially slidable; and wherein the first and second ends of the second inflatable element are axially slidable. In other embodiments, the straddle packer assembly may include a first inflatable element and a second inflatable element, each having a first end and a second end; wherein the first end of the first inflatable element is fixed and the second end of the first inflatable element is axially slidable; and wherein the first and second ends of the second inflatable element are axially slidable; and a slidable element disposed between the second end of the first inflatable element and the first end of the second inflatable element. In yet other embodiments, the straddle packer assembly may include a mandrel on which is mounted a first packer and a second packer coupled to the first packer, wherein the first packer has a first end fixed to the mandrel and a second end axially slidable along the mandrel, and wherein the second packer has a first end and a second end and both of the first and second ends of the second packer are axially slidable along the mandrel.

For any one of the forgoing straddle packer assembly embodiments, the following elements may be included, alone or in combination with any other elements:

- The first inflatable element and the second inflatable element are formed of a single elastomeric component.
- The first inflatable element and the second inflatable element are separate packer assemblies coupled to one another by the slidable element.
- The first inflatable element and the second inflatable element are separate, spaced apart elastomeric components.
- A mandrel on which the first inflatable element and the second inflatable element are mounted, wherein the first end of the first inflatable element is fixed to the mandrel and the second inflatable element is slidingly mounted on the mandrel.
- The slidable element includes one or more ports, inflow control devices or other flow control mechanisms to allow wellbore fluid adjacent slidable element to flow into mandrel.

The slidable element seals the second end of the first inflatable element and the first end of the second inflatable element.

An inflation manifold assembly having common line in fluid communication with a first inflation line and a second inflation line; a first valve controlling flow between the common line and the first inflation line and a second valve controlling flow between the common line and the second inflation line.

An inflation manifold assembly having common line in fluid communication with a first inflation line and a second inflation line; a first valve controlling flow between the common line and the first inflation line and a second valve controlling flow between the common line and the second inflation line; and a third valve controlling flow between the common line and each of the first and second inflation lines.

Likewise, a method for installing a straddle packer assembly has been described. In one or more embodiments, the straddle packer installation method may include positioning an uninflated straddle packer assembly adjacent a zone of interest in a wellbore; securing one end of a first radially expandable component of the straddle packer assembly; and initiating inflation of the first radially expandable component, thereby causing one or more additional radially expandable components of the straddle packer to move axially towards the first radially expandable component. In other embodiments, the straddle packer installation method may include securing one end of a first radially expandable component of the straddle packer assembly; and initiating inflation of the first radially expandable component, thereby causing one or more additional radially expandable components of the straddle packer to move axially towards the first radially expandable component. In yet other embodiments, the straddle packer installation method may include positioning an inflating a straddle packer assembly having a first radially expandable component and a second radially expandable component in a wellbore, and thereafter, individually inflating each of the radially expandable components separately from one another. In yet other embodiments, the straddle packer installation method may include positioning in a wellbore a straddle packer assembly having a first radially expandable component and a second radially expandable component, and thereafter, securing one end of a first radially expandable component of the straddle packer assembly; and initiating inflation of the first radially expandable component, thereby causing the second radially expandable component to move axially towards the first radially expandable component; continuing to inflate the first radially expandable component until it seats against a wellbore wall. In yet other embodiments, the straddle packer installation method may include positioning a straddle packer assembly having two or more radially expandable components in a wellbore, and thereafter inflating a first radially expandable component causing additional radially expandable components of the straddle packer assembly to move axially towards the first radially expandable component. In yet other embodiments, the straddle packer installation method may include positioning a straddle packer assembly having a first radially expandable component and a second radially expandable component in a wellbore and thereafter individually inflating each radially expandable component so that the axial distance between the first and second radially components remains substantially constant. In yet other embodiments, the straddle packer installation method may include positioning a straddle packer assembly having a first radially expandable component and a second radially expandable component in a wellbore, and thereafter individually inflating each radially expandable component so that the axial distance between the first and second radially components does not increase.

For any one of the forgoing straddle packer installation embodiments, the following steps may be included, alone or in combination with any other steps:

Separately initiating inflation of a second radially expandable component while continuing to inflate the first expandable component.

Continuing to inflate the second expandable component once the first expandable component has engaged a wellbore wall.

Individually inflating successively the one or more additional radially expandable components.

Continuing to inflate the first radially expandable component until it engages a wellbore wall, while maintaining the second inflatable component in a spaced apart relationship from the wellbore wall.

The second end of the first radially expandable component and the first end of the second radially expandable component are fixed once the first radially expandable component seats against the wellbore wall, and thereafter inflating the second radially expandable component so as to draw the second end of the second radially expandable component axially toward the fixed ends.

The wellbore wall is a casing wall of a cased wellbore.

The wellbore wall is the formation wall of an uncased wellbore.

While various embodiments have been illustrated in detail, the disclosure is not limited to the embodiments shown. Modifications and adaptations of the above embodiments may occur to those skilled in the art. Such modifications and adaptations are in the spirit and scope of the disclosure.

What is claimed is:

1. A straddle packer assembly comprising:

a mandrel on which is mounted a first inflatable element and a second inflatable element, each inflatable element having a first end and a second end;

wherein the first end of the first inflatable element is fixed relative to the mandrel and the second end of the first inflatable element is axially slidable relative to the mandrel;

wherein the first and second ends of the second inflatable element slidingly engage the mandrel such that the entire second inflatable element is axially slidable along the mandrel; and a slidable element disposed between the first inflatable element and the second inflatable element and wherein the slidable element couples the first end of the second inflatable element to the second end of the first inflatable element.

2. The straddle packer assembly of claim 1, wherein the first inflatable element is a first packer assembly and the second inflatable element is a second packer assembly.

3. The straddle packer assembly of claim 2, wherein the first inflatable element and the second inflatable element are separate packer assemblies coupled to one another by the slidable element.

4. The straddle packer assembly of claim 1, wherein the first inflatable element and the second inflatable element are integrally formed as a single elastomeric component, and wherein the slidable element is positioned between the first end of the second inflatable element and the second end of the first inflatable element to clasp the integrally formed elastomeric component, so as to define the first and second inflatable elements from upper and lower portions of the single elastomeric component.

5. The straddle packer assembly of claim 1, wherein the first inflatable element and the second inflatable element are separate, spaced apart elastomeric components.

6. The straddle packer assembly of claim 2, wherein the slidable element includes one or more ports, inflow control devices or other flow control mechanisms to allow wellbore fluid adjacent slidable element to flow into mandrel.

7. The straddle packer assembly of claim 2, wherein the slidable element seals the second end of the first inflatable element and the first end of the second inflatable element.

8. The straddle packer assembly of claim 1, further comprising an inflation manifold assembly having common line in fluid communication with a first inflation line and a second inflation line; a first valve controlling flow between the common line and the first inflation line and a second valve controlling flow between the common line and the second inflation line; and a third valve to permit pressure between the first and second inflatable components to be equalized once inflated.

9. The straddle packer assembly of claim 1, further comprising an inflation manifold assembly having common line in fluid communication with a first inflation line and a second inflation line; a first valve controlling flow between the common line and the first inflation line and a second valve controlling flow between the common line and the second inflation line; and a third valve controlling flow between the common line and each of the first and second inflation lines to permit pressure between the first and second inflatable components to be equalized once inflated.

10. A straddle packer assembly comprising a mandrel on which is mounted a first packer and a second packer coupled to the first packer, wherein the first packer has a first end fixed to the mandrel and a second end axially slidable along the mandrel, and wherein the second packer has a first end and a second end and both of the first and second ends of the second packer slidingly engage the mandrel such that the entire second packer is axially slidable along the mandrel; and a slidable element disposed between the first packer and the second packer and that couples the first end of the second packer to the second end of the first packer.

11. The straddle packer assembly of claim 10, further comprising a slidable element disposed between the second end of the first inflatable element and the first end of the second inflatable element.

12. The straddle packer assembly of claim 10, wherein the slidable element includes one or more ports, inflow control devices or other flow control mechanisms to allow wellbore fluid adjacent slidable element to flow into mandrel.

13. The straddle packer assembly of claim 10, further comprising an inflation manifold assembly having common line in fluid communication with a first inflation line and a second inflation line; a first valve controlling flow between the common line and the first inflation line and a second valve controlling flow between the common line and the second inflation line; and a third valve to permit pressure between the first and second packers to be equalized once inflated.

14. A method for installing a straddle packer assembly, the method comprising:

positioning an uninflated straddle packer assembly adjacent a zone of interest in a wellbore; securing one end of a first radially expandable component of the straddle packer assembly to a mandrel;

slidingly engaging the mandrel with one or more additional radially expandable components consecutively spaced apart along the mandrel by a slidable element between consecutive ones of the radially expandable components; and initiating inflation of the first radially expandable component, thereby causing the one or more additional radially expandable components of the straddle packer to move axially towards the first radially expandable component.

15. The method of claim 14, further comprising individually inflating each radially expandable component so that the axial distance between the first and second radially components remains substantially constant.

16. The method of claim 14, further comprising, separately initiating inflation of a second radially expandable component while continuing to inflate the first expandable component.

17. The method of claim 14, further comprising, continuing to inflate the second expandable component once the first expandable component has seated against a wellbore wall.

18. The method of claim 14, further comprising, individually inflating successively the one or more additional radially expandable components.

19. The method of claim 14, further continuing to inflate the first radially expandable component until the first radially expandable component seats against a wellbore wall, while maintaining the second inflatable component in a spaced apart relationship from the wellbore wall.

20. The method of claim 14, further comprising fixing the second end of the first radially expandable component and the first end of the second radially expandable component once the first radially expandable component seats against the wellbore wall, and thereafter inflating the second radially expandable component so as to draw the second end of the second radially expandable component axially toward the fixed ends.

* * * * *